United States Patent [19]

Anselmo et al.

[11] Patent Number: 4,593,909

[45] Date of Patent: Jun. 10, 1986

[54] GOLF CLUB SWING TRAINING DEVICE

[76] Inventors: John Anselmo, 3818 S. Sycamore, Santa Ana, Calif. 92707; William A. Blatnik, 5412 Scrivener, Long Beach, Calif. 90808

[21] Appl. No.: 580,714

[22] Filed: Feb. 16, 1984

[51] Int. Cl.[4] ..... A63B 69/36

[52] U.S. Cl. ..... 273/188 R; 273/183 B

[58] Field of Search ..... 273/188 R, 183 R, 183 B, 273/188 A, 189 R, 189 A, 190 R, 190 B

[56] References Cited

U.S. PATENT DOCUMENTS 1,530,519 3/1925 Remington ..... 273/188 R 1,561,960 11/1925 Ungar ..... 273/188 R 1,703,375 2/1929 Volk ..... 273/188 R 2,893,736 7/1959 Tesi ..... 273/188 R

*Primary Examiner*—George J. Marlo

*Attorney, Agent, or Firm*—Sellers and Brace

[57] ABSTRACT

Disclosed is a knock down golf swing training aid equally suitable for use indoors and outdoors. The main frame is formed of tubular components including a large area base assembly, and a vertically adjustable upright post mounted medially of the rear edge of the base assembly, outriggers for the base assembly, a safety harness, and a plurality of belt loops adapted for assembly loosely about either or both ends of the player's torso while practising golf swings.

11 Claims, 10 Drawing Figures

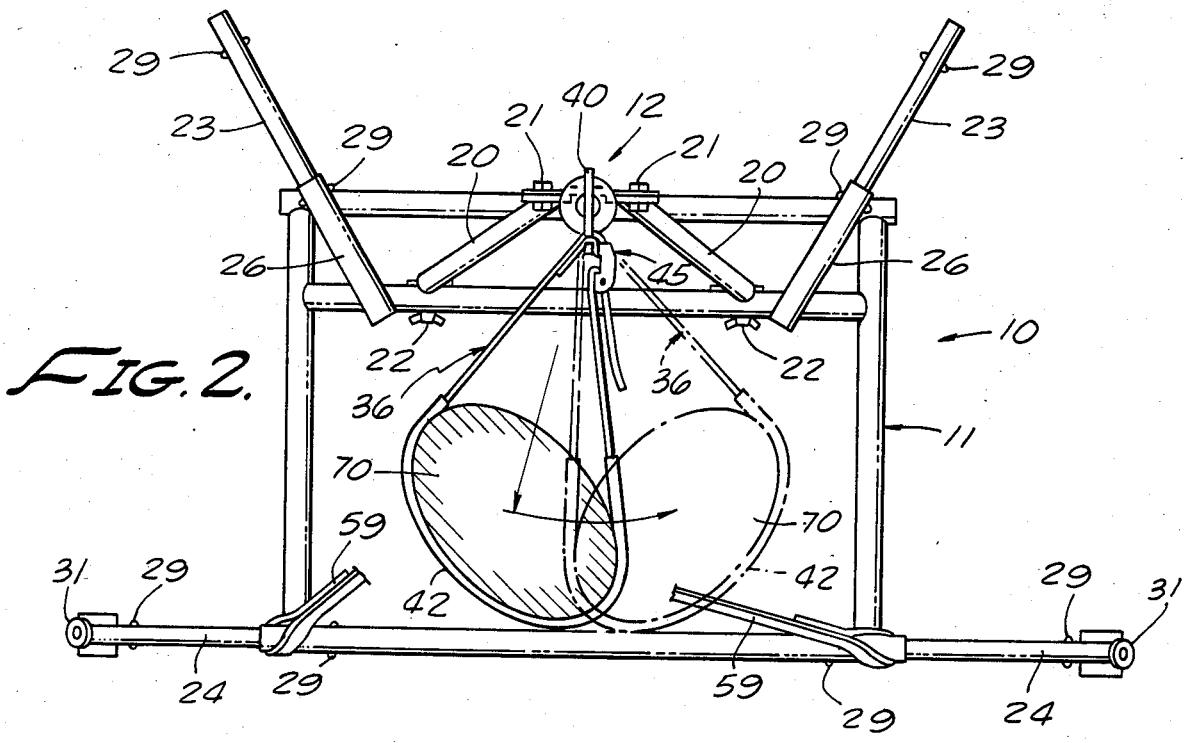
FIG. 2.
FIG. 3.
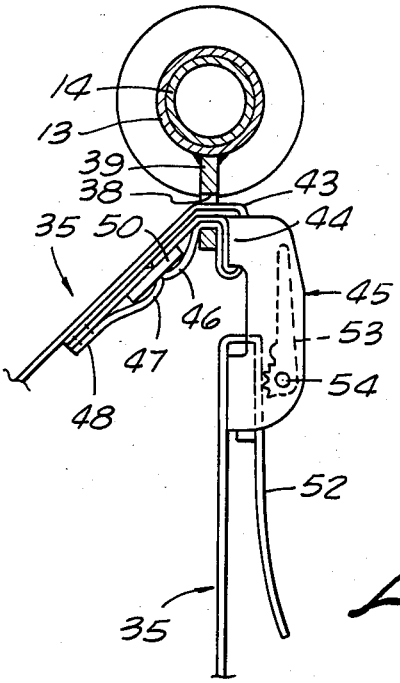
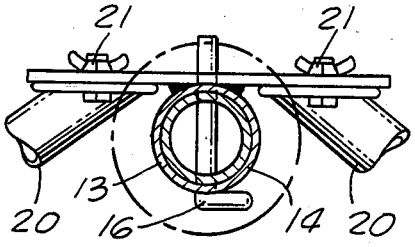
FIG. 4.
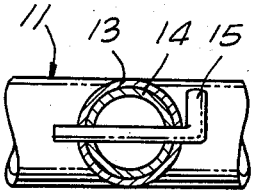
FIG. 5.
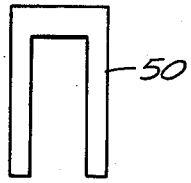
FIG. 3A.
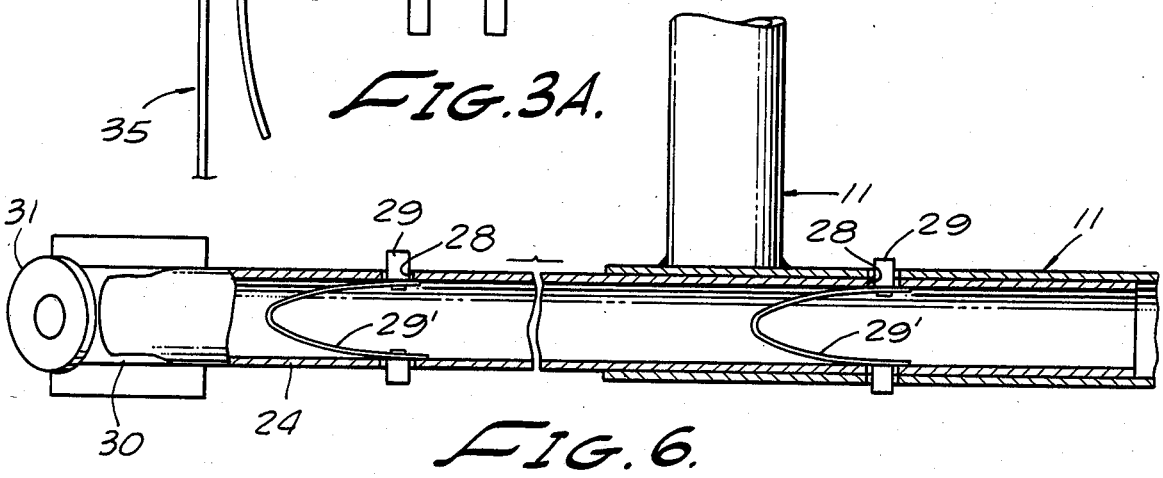
FIG. 6.

GOLF CLUB SWING TRAINING DEVICE

This invention relates to training aids, and more particularly to a unique knock down golf swing training aid for use by a golfer while practising golf swings.

BACKGROUND OF THE INVENTION

Learning to swing a golf club involves control of the muscular system of the entire body and is a skill acquired with difficulty by many players. Not infrequently, the novice succeeds in training certain of the muscular complexes in an erroneous manner with the result that he acquires one or more improper golf swing habits very difficult to eradicate and replace by proper retraining of the involved muscular complex. In recognition of the long standing problem, various proposals have been made by prior inventors to resolve the problem by the provision of a variety of widely differing training and aid devices and expedients. Representative of these proposals are represented in the disclosures of the following U.S. Pat. Nos.: Remington 1,530,519; Ungar 1,561,960; Johnston 2,469,301; Wilson 3,873,317; Blasi 3,937,473 and Chen 4,318,546.

SUMMARY OF THE INVENTION

This invention provides a compactly stowable, knock down golf swing training aid avoiding the aforementioned shortcomings and other disadvantages of prior devices proposals and provides a highly efficient and effective device aiding a golfer in acquiring a proper golf swing. The device embodies means for supporting one or a pair of strapping loops securable to individual fixed supports located generally opposite the upper and lower ends of the player's torso. These loops have a girth very substantially in excess of a player's girth and enabling him to assume a proper swing stance well forward of these supports. The straps are adjusted so that the player may assume a swing stance with one or both belts in light tension spaced well forwardly of the strap support points. This permits the player to execute a swing while rotating his torso within the loop and to swing the torso through a short arc about a pivot point provided by the strap support. If the strapping is applied about the upper end of the torso, immediately below the armpits, the fixed support for the strapping is preferably located at a slightly higher level than the armpit thereby discouraging the player from dipping or raising his body during the swing. The lower strapping has a similar capability.

The training aid includes a base assembly detachably connectable to the lower end of an upright post for the strapping and also preferably includes a pair of carriage wheel auxiliaries and adjustable outriggers for the base which includes provisions for inserting stakes into the ground when the device is used outdoors. An important additional auxiliary comprises a safety harness having belting securable about the player's waist and adjustable guard straps connected between the opposite forward sides of the belting and the respective outer forward corners of the base assembly. The safety harness is adjusted to be free of tension during a normal swing to have one or the other of its guard straps placed in tension to protect the player against becoming unbalanced during the golf swing.

Accordingly, it is a primary object of this inventon to provide a unique golf swing training aid for enabling a golf player to acquire an ideal golf swing stance and routine.

Another object of the invention is the provision of a golf swing training aid comprising belt means adapted to loosely encircle one end of the player's torso from a support point located substantially behind the player's back and allowing the torso to pivot freely within the tensionsed forward portion of the belt loop while also permitting limited arcuate movement of the torso about the support point for the loop.

Another object of the invention is the provision of a compactly storable, knock down training aid usable indoors or outdoors and useful in developing an ideal golf swing free of body dip and rise.

Another object of the invention is the provision of a portable golf swing training aid composed of readily assembled and disassembled components and including a pair of torso encircling belt loops and a safety harness.

Another object of the invention is the provision of a knock down portable golf swing training aid utilizing an upright control post of vertically adjusted length selectively supporting a pair of flexible belt loops usable individually or in pairs to encircle the opposite ends of the player's torso.

These and other more specific objects will appear upon reading the following specification and claims and upon considering in connection therewith the attached drawing to which they relate.

Referring now to the drawing in which a preferred embodiment of the invention is illustrated:

FIG. 2 is a top plan view of the training aid shown in FIG. 1, but omitting the lower torso belt and indicating the position of the belt encircling the player's chest and indicating the position thereof at the opposite ends of a proper golf swing;

FIG. 3 is a fragmentary sectional view on an enlarged scale taken along line 3—3 of FIG. 1 and showing details of the belt loop adjusting and anchoring means;

FIG. 3A is a side elevational view of the U-shaped keeper used in holding the belt loops assembled to the upright post;

FIG. 4 is a fragmentary cross-sectional view taken along line 4—4 on FIG. 1;

FIG. 5 is a cross-sectional view on a large scale taken along line 5—5 on FIG. 1;

FIG. 6 is a fragmentary cross-sectional view taken along line 6—6 on FIG. 1;

Figure 1:
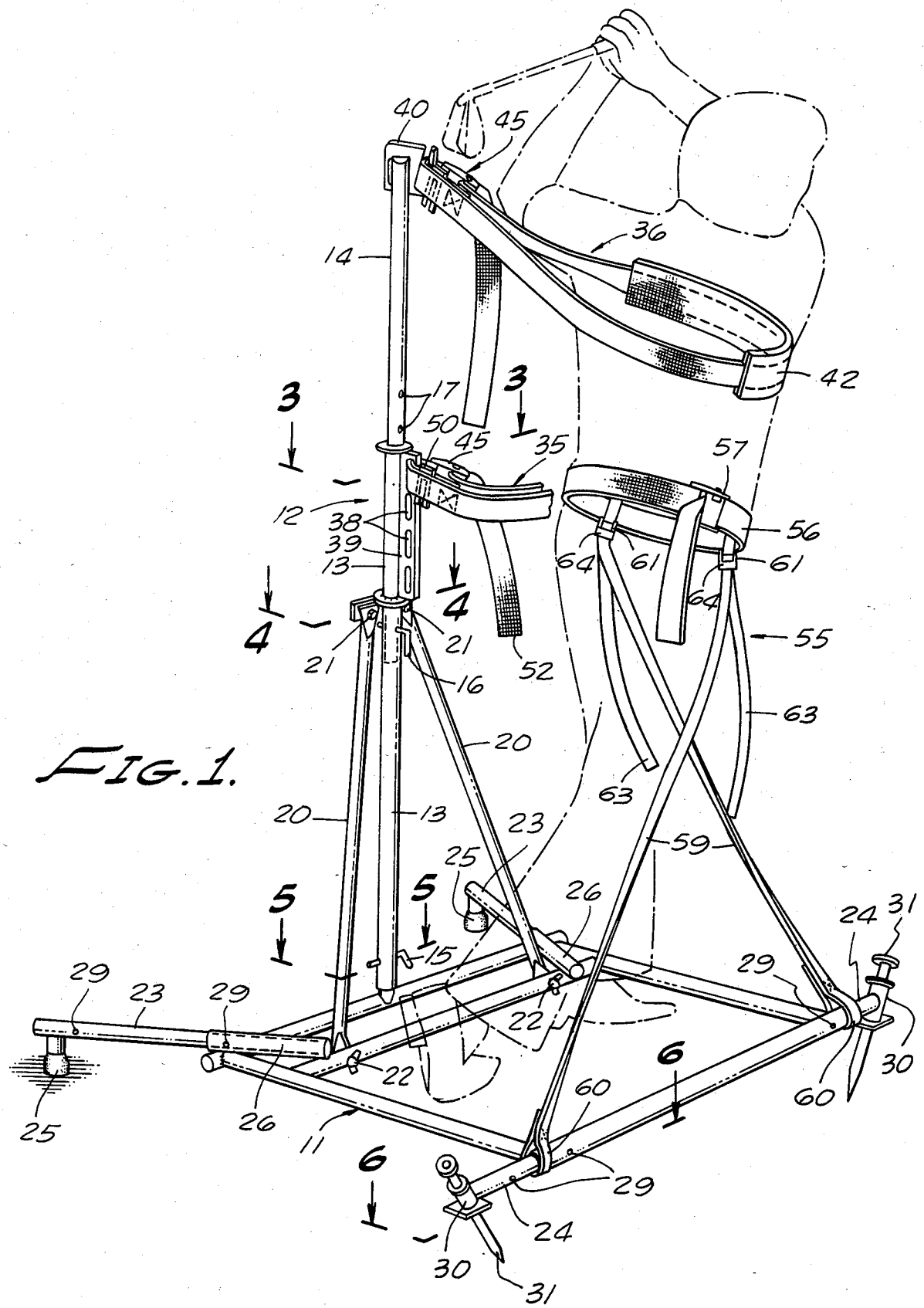
FIG. 1 is a perspective view of an illustrative embodiment of the invention golf swing training aid and indicating the position of the belt loop at the end of a proper golf club swing.

Referring initially more particularly to FIG. 1, there is shown one preferred embodiment of the training aid, designated generally 10, formed for the most part of tubular components including a base assembly 11 of a generally square configuration located at the lower end of the detachable upright post assembly 12. Post 12 comprises a lower section 13 telescopically and adjustably supporting a tubular upper section 14 therein. Lower section 13 is held detachably to the base assembly by a snug fitting pin 15 and upper section 14 is held telescopically assembled to the upper end of section 13 in any one of a number of different elevated positions by a friction fitting pin 16 extending through one of the holes 17 in section 14. Reinforcing and stabilizing the support for post 12 are a pair of detachable struts 20, 20 having their upper ends secured to post section 13 by thumb nuts 21, the lower ends of the struts being detachably secured to the base assembly by thumb nuts 22.

Base assembly 11 is sufficiently large to permit the player to stand within its perimeter and to swing a golf club freely without any interference from any structural members. Usually it is desirable to further stabilize the assembled main body of the training aid by inserting outriggers 23, 24 to its respective corners. As herein shown by way of example, tubular outriggers 23 are of L-shape with the shorter upright leg provided with the resilient cup 25 and the longer leg being telescopically assemblable within a tubular member 26 welded to the base crosswise of its rear corner. Members 26 are preferably provided with openings 28 to receive locking pins 29 mounted on the leg ends of a U-shaped spring 29' (FIG. 6) spot welded to the interior of the outrigger. Outriggers 24 have a tubular main body telescopically assembled in the forward transverse tube of base assembly 11 and retained in place by spring supported pins 29. The outer ends are provided with inclined open ended tubular sections 30 to receive stakes 31 driven into the ground when the aid is being used outdoors.

The rigid upright post assembly 12 is employed to support a pair of adjustable belt loops 35, 36 from vertically spaced points therealong located directly behind the backbone of a player positioned to address a ball. As clearly appears from FIG. 1, the point of attachment of each of these belt loops to the post is spaced well behind the player's back, the lower belt being long enough to embrace the lower end of the player's torso and the upper belt loop 36 being positioned to encircle the upper end of the torso directly beneath the armpits. The point of connection of the upper belt to post 12 is preferably at a level substantially above the armpits and thereby effective in discouraging the player from either dipping or rising during the swing, a manoeuvre usually accompanied by bending the knees objectionably. The proper positioning of the connection point for belt 36 is readily accomplished by placing the assembly pin 16 in an appropriate one of the holes 17 in the upper section 14 of the post 12.

Lower belt loop 35 is mountable in one of a row of slots 38 arranged and in end-to-end relation in plate 39 welded to the forward side of post section 13. The upper belt loop 36 is mounted in a slotted plate 40 welded to the upper end of post section 14.

The manner in which one end of the belts 35 and 36 is held fixedly but detachably anchored to the post 12 will now be described with particular reference to FIGS. 3 and 3A. The belt loops are typically formed of flexible high-strength webbing which is threaded through a short length of flattened tubular webbing 42 in the area in contact with the player's torso, as best appears from FIG. 1. The lefthand end of the belting is folded back on itself to form a flattened loop 43. This flattened end of this loop is threaded through one of the slots 38 and then through an opening (not shown) in one end 44 of a belt clamping buckle 45. The end of the loop is then threaded backwardly through slot 38 sufficiently to provide a loop 46. One leg of the U-shaped keeper plate 50 shown in FIG. 3A is then inserted in loop 46 as the other leg is inserted in loop 47 thereby anchoring one end of belt 35 firmly assembled to slot 38 with buckle 45 retained captive on the opposite face of slot 38.

Buckle 45 is of a well known construction through which the free end 52 of belt 35 can be inserted in the manner indicated in FIG. 3 and firmly clamped in a desired position by the clamping device 53 pivotally assembled to the clamp by pivot pin 54. From the foregoing it will be clear that the belt loop 36 can be quickly shifted between slots 38 merely by withdrawing the keeper 50 and unthreading the loop 46 from the clamping buckle 45 and slot 38 and reassembling these members in a different slot by the reverse procedure described above.

The safety harness assembly, designated generally 55, comprises a webbed belt 56 equipped with a suitable clamping buckle 57 such as the type just described for belt loops 35, 36 and, in addition, a pair of guard straps 59, 59. The lower end of these straps are provided with loops 60 embracing the outer ends of the front tube of base assembly 11. The upper ends of straps 59 pass through loops 61 spaced adjacent the opposite ends of the forward portion of belt 56 adjacent a respective one of the player's hips. The free ends 63 of these straps pass through clamping devices 64 constructed to hold the straps 59 in a proper length for a particular player. In this connection both straps should be sufficiently loose to permit a full swing of the player's body but for at least one to become taut with even slight overswing of the player's body. When so arranged the guard straps do not interfere in any way with the golf swing but should the player be off balance in the slightest degree at either the beginning or the conclusion of the swing one of the belts will become taut to stabilize the player as well as to make him aware that some portion of the swing was improper.

Referring now to FIG. 2, it is pointed out that the ellipses 70, 70 represents one end of the player's torso, the left hand ellipse representing a typical position of the torso at the beginning of club swing and the right-hand ellipse representing the position of the torso at the end of the same swing. Of significance is the fact that the loop 35 is adjusted to position the center of the torso well forwardly of the support post 12. It will be apparent from FIG. 2, that the straight portion of the outer or left hand leg of the loop 36 is substantially shorter than the straight right hand portion of the loop whereas, when the player has completed his swing the lengths of the straight portion of these loop legs are reversed. In other words, the player's torso has rotated counterclockwise about its own axis within loop 36. Likewise the center of the torso has shifted counterclockwise through a short arc centered at the connection of belt loop 36 to post 12. These same conditions and operating features apply equally to the lower belt 35.

During the swing, the player takes a stance placing each leg of the loop in light tension and maintains this tension throughout the swing, the tension being relatively small, the player's torso rotates readily within the loop as the loop cooperates with the post in maintaining the torso in an upright position. This function is true when using either loop and particularly prevalent when using the upper belt loop 36 since this loop is positioned in the armpits and becomes increasingly tensioned if there is any tendency on the part of the player to bend his knees or to dip his body towards the ball.

Figure 7:
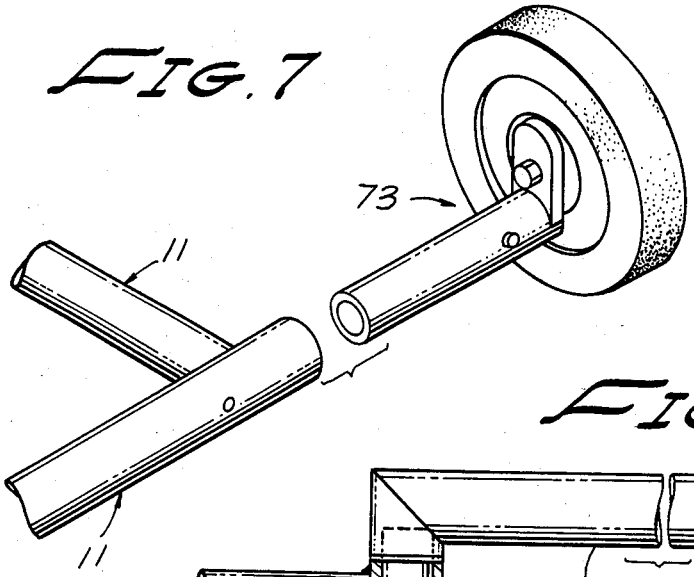
FIG. 7 is a fragmentary exploded view showing one of a pair of carriage wheels for the base assembly in position for assembly thereto.

Referring to FIG. 7, there is shown one of a pair of wheel assemblies 73 which may be telescopically assembled within the forward corners of base assembly 11 in lieu of the outriggers 24. When so assembled, the training aid 10 is readily wheeled between a place of storage and a place of transport.

Figure 9:
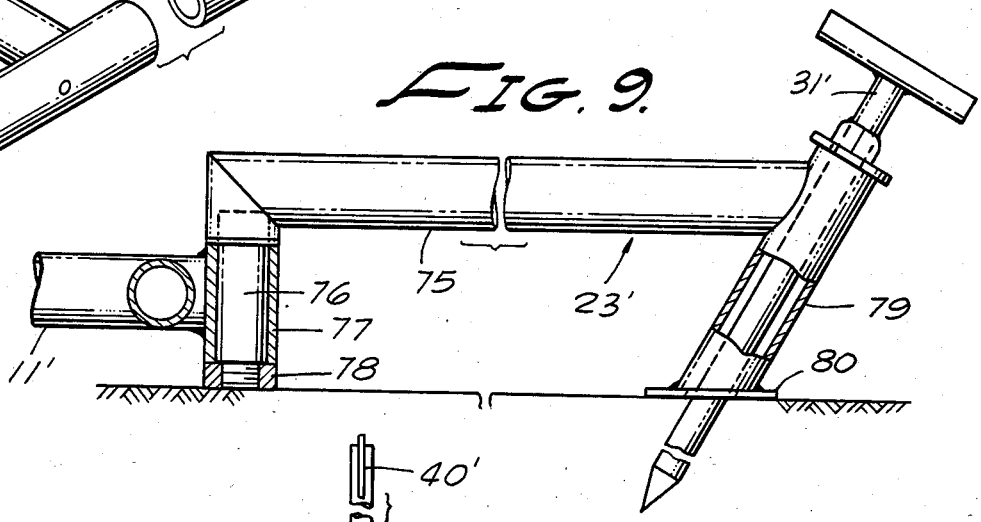
FIG. 9 is a fragmentary view on an enlarged scale showing a detail of one of the sloping outriggers.
Figure 8:
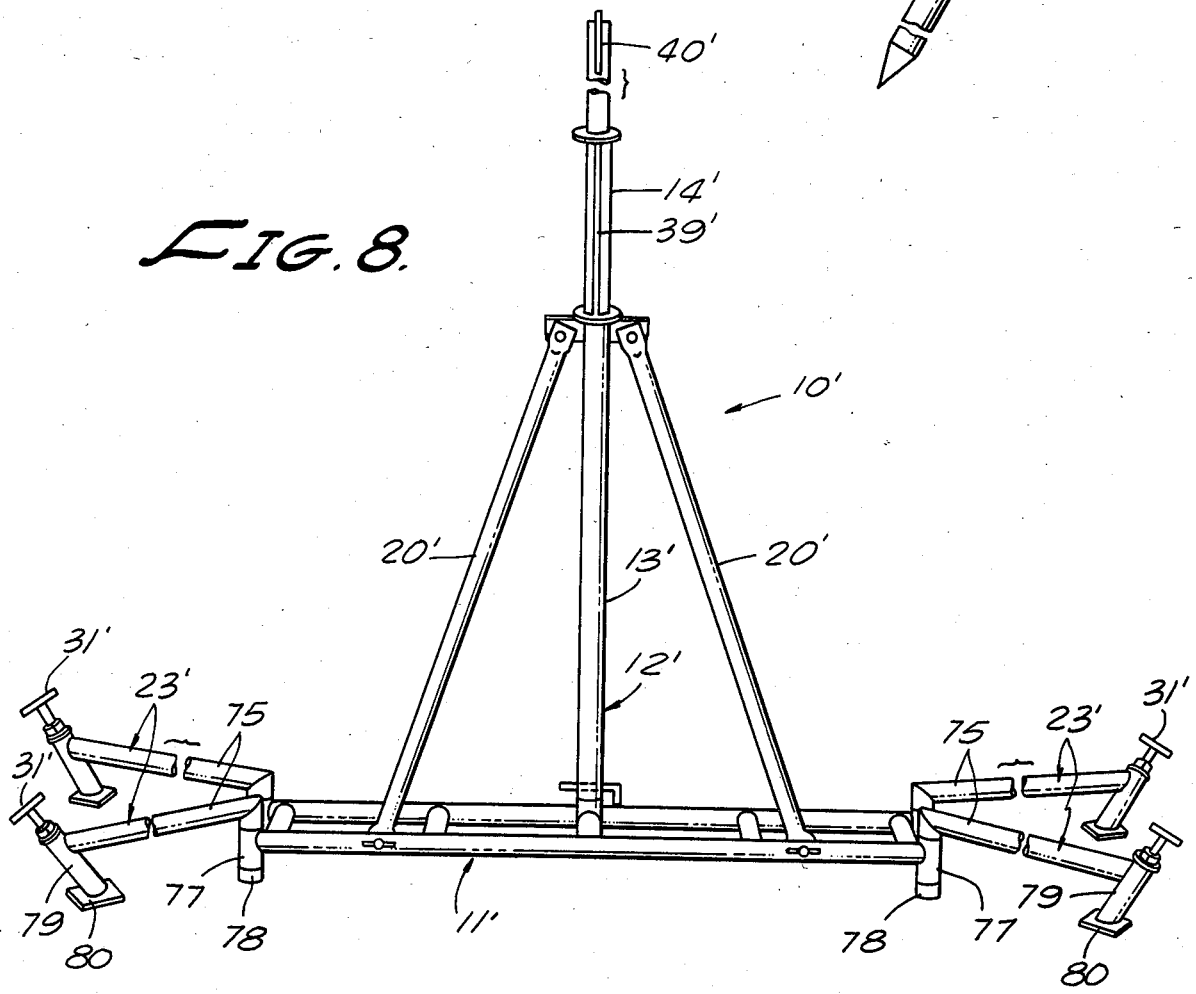
FIG. 8 is an elevational perspective view of a modified embodiment of the training aid utilizing an abbreviated base assembly confined to an area behind the golf player and utilizing a modified form of swivelly supported outriggers.

Referring now to FIGS. 8 and 9, there is shown a simplified embodiment of the training aid designated generally 10' and wherein the same or similar components are designated by the same characteristics employed above but distinguished therefrom by the addition of a prime. The principal difference resides in the fact that the base assembly 11' is restricted to an area rearward of the player and to the structure necessary to rigidly support the post 12'. A further distinction resides in the fact that base 11' is provided with four generally similar but longer outriggers 23'. The details of outrigger 23' are best shown in FIG. 9 and are of inverted U-shape having a long horizontal tubular portion 75 and an inner leg 76 held journalled in a tubular socket 77 of the base assembly by a nut 78. The tubular outer leg 79 has a pad 80 at its lower end positioned to rest against either the ground or an indoor floor. When used outdoors, leg 79 receives a T-shaped stake 31' which is driven in the ground to anchor base assembly 11 and its post 12' firmly in an upright position. The FIG. 8 embodiment is normally not used by the novice since it lacks safety belt auxiliary, but experienced and professional players often have a preference for it becuase of its greater simplicity and the fact that the base assembly is confined to an area rearward of the player.

While the particular knock down golf swing training aid herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A golf swing training aid suitable for use by the novice and by the experienced golfer comprising:

rigid upright support means positionable behind the back of the golfer and having a height free of interference with a golf club swing;

flexible loop means sufficiently large to form an elongated loop sized to loosely embrace the golfer's torso within the larger forward half thereof with the rearward half thereof unoccupied and nonslidably attached to said support means and which loop means is normally taut while the golfer is executing a golf swing;

said loop means being adapted and effective (1) to permit the player's torso to rotate clockwise through a limited arc within said loop means and (2) to permit the torso to swing bodily clockwise in an arc centered at the anchorage of said loop means to said support means thereby to maintain the axis of the player's torso substantially upright and free of appreciable rise and fall during the golf swing;

said support means including a plurality of vertically spaced-apart elongated slots, one end of said adjustable loop means being adapted to be flattened with the free end thereof threaded through a selected one of said slots, then through a slot at one end of a releasable clamp device attached to said loop means and then back through said selected one slot;

anchor means for anchoring the leading end of said flattened loop to the juxtaposed face of said flexible loop means thereby to prevent lengthwise movement of said loop means in said slot;

said anchor means for said flattened loop comprising a U-shaped member of rigid material insertable crosswise of said belt with one leg having a snug fit in a pocket formed crosswise of the flattened end of said loop and the other leg having a snug fit in an adjacent pocket extending crosswise of said flexible loop means.

2. A training aid as defined in claim 1 characterized in that said loop means is adjustable in length to accomodate torsos of different girth and the positioning thereof relative to said upright support means in a golf swing stance spaced forwardly of said support means.

3. A training aid as defined in claim 1 characterized in that said flexible loop means is secured to said support means at a level opposite the lower end of the player's torso.

4. A training aid as defined in claim 1 characterized in that said flexible loop means is secured to said support means at a level adjacent the upper end of the player's torso.

5. A training aid as defined in claim 1 characterized in the provision of safety harness means comprising belting securable about the player's waist at hip level, a pair of adjustable tether straps having upper ends securable to said belting adjacent a respective hip of the player, and the lower ends of said strapping being securable to anchorage means at the player's foot level and at points laterally and forwardly of the player while in a swing stance, said strapping normally being untensioned during a normal golf swinging but being adapted to become tensioned if the play swing is abnormal and/or the player tends to become unbalanced and out of stance control.

6. A knock down golf swing training aid useful indoors and outdoors comprising:

a base assembly having a perimeter sized to accommodate therewithin the player free of interference while executing thw swing of a golf club;

rigid upright means of adjustable length detachably securable to the rear side of said base assembly;

flexible strapping sufficiently long to form a closed loop of generally elongated shape of a size loosely embracing one end of the player's torso in the larger forward half thereof with the remaining portions of said strapping along the rear half of said loop converging to an apex pivotally attached to said rigid upright means generally opposite said one end of the player's torso and effective to maintain his torso firmly upright and against rise and fall during execution of a full golf swing, said strapping also permitting the torso to rotate counterclockwise within and relative to said loop to a normal limited degree about the vertical axis of the player's torso and also permitting the torso to swing in an arc from left to right at a predetermined radial distance from the pivot connection of said strapping to said rigid upright means;

outrigger means detachably securable to spaced apart points of the perimeter of said base assembly for use in increasing the stability of said training aid;

said outrigger means comprising elongated rigid extensions movably attachable to spaced apart portions of said base assembly in positions projecting horizontally outwardly therefrom with the outer ends thereof in contact with the underlying supporting surface for said base assembly; and the outer ends of at least some of said outrigger means being provided with an opening adapted to receive stake means adapted to be driven into the ground.

7. A knock down training aid as defined in claim 6 characterized in that said base assembly is provided with a plurality of horizontally disposed wells adapted to telescopically seat a respective one of said outrigger means.

8. A knock down training aid as defined in claim 6 characterized in that said rigid upright means includes a plurality of tubular members constructed for telescopic assembly in different assembled lengths; and the upper end of one of said tubular members being provided with means forming a row of elongated openings arranged in end-to-end relation and adapted to have a loop of strapping anchored in a selected one thereof.

9. A knock down training aid as defined in claim 8 characterized in the provision of safety harness means comprising belt means adapted to be assembled about the player's waist while using said aid, and a pair of guard straps attachable to spaced apart points along the front of said belt means when in place about the player, the opposite ends of said guard straps being secured to a respective forward corner of said base assembly.

10. A knock down training aid as defined in claim 9 characterized in that said guard straps each include means for adjusting the length thereof to accommodate the height of the player.

11. A knock down training aid as defined in claim 6 characterized in the provision of a second long flexible strap equipped with clamping means to hold the opposite ends thereof firmly clamped together to form a second oval loop of a size loosely embracing a second end of a player's torso, said second strap being pivotally attached to said upright support means.

* * * * *